US006415726B1

(12) United States Patent
Hartsell, Jr.

(10) Patent No.: US 6,415,726 B1
(45) Date of Patent: Jul. 9, 2002

(54) LOCK-STITCH NEEDLE CHUCK FOR A PLACKET SEWING MACHINE

(75) Inventor: Billie W. Hartsell, Jr., Mt. Pleasant, NC (US)

(73) Assignee: John E. Fox, Inc., Charlotte, NC (US)

( * ) Notice: Subject to any disclaimer, the term of this patent is extended or adjusted under 35 U.S.C. 154(b) by 0 days.

(21) Appl. No.: 09/579,876

(22) Filed: May 26, 2000

(51) Int. Cl.[7] ..... D05B 19/00; D05B 69/18

(52) U.S. Cl. ..... 112/272; 112/475.02; 112/475.09

(58) Field of Search ..... 112/272, 275, 112/277, 470.01, 470.03, 470.05, 475.02, 475.03, 475.09, 80.45, 163; 2/77, 122, 115, 121

(56) References Cited

U.S. PATENT DOCUMENTS

| | | | | |
|---|---|---|---|---|
| 4,519,326 A | * | 5/1985 | Green et al. | 112/80.45 |
| 4,850,292 A | | 7/1989 | Levy et al. | |
| 5,862,767 A | | 1/1999 | Hartsell | |
| 5,868,090 A | | 2/1999 | Hartsell | |

OTHER PUBLICATIONS

Juki Corporation; "2–Needle, Needle–feed, Lockstitch Machine with an Automatic Thread Trimmer"; Entire Brochure; Published Dec., 1994.

Juki Corporation; "Feed–off–the–arm, Double Chainstitch Machine"; Entire Brochure; Published Jan., 1994.

Juki Corporation; "High–Speed, Flat Bed, 2–Needle, Double Chainstitch Industrial Sewing Machine"; Entire Brochure; Published May, 1991.

Juki Corporation; "2–Needle, Needle–feed, Lockstitch Machine—2–Needle, Bottom–Feed, Lockstitch Machine"; Entire Brochure; Published Nov., 1994.

* cited by examiner

*Primary Examiner*—Peter Nerbun

(74) *Attorney, Agent, or Firm*—Adams, Schwartz & Evans, P.A.

(57) ABSTRACT

A placket sewing machine attaches a placket patch to a fabric part of a garment in overlying relation to form a multiple layer placket assembly. The placket sewing machine includes a base defining a working surface of the sewing machine, and including a fabric moving feed dog for moving the overlaid placket patch and fabric part downstream through the sewing machine. A reciprocating needle chuck has first and second needle openings formed in a staggered forward and rearward arrangement. First and second sewing needles are positioned within respective needle openings of the chuck. The sewing needles are adapted for carrying respective ends of thread into and through the overlaid placket patch and fabric part to form first and second parallel lines of stitches in the placket assembly. The first line of stitches extends a greater distance along the length of the overlaid placket patch and fabric part than the second line of stitches. A sewing motor is operatively connected to the needle chuck for actuating the chuck during operation of the sewing machine. A fabric cutter is located downstream of and centrally disposed between the first and second sewing needles for cutting the overlaid placket patch and fabric part after sewing.

10 Claims, 9 Drawing Sheets

Fig. 8
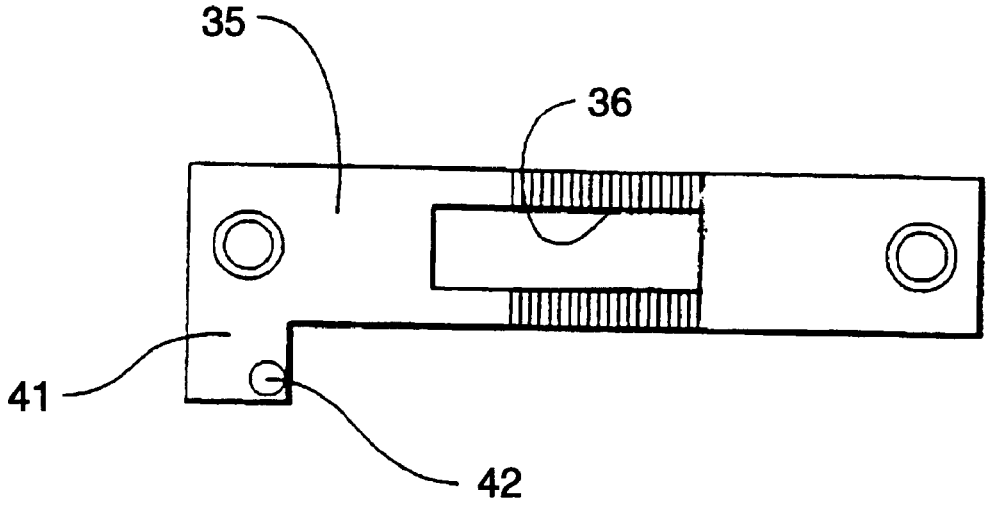
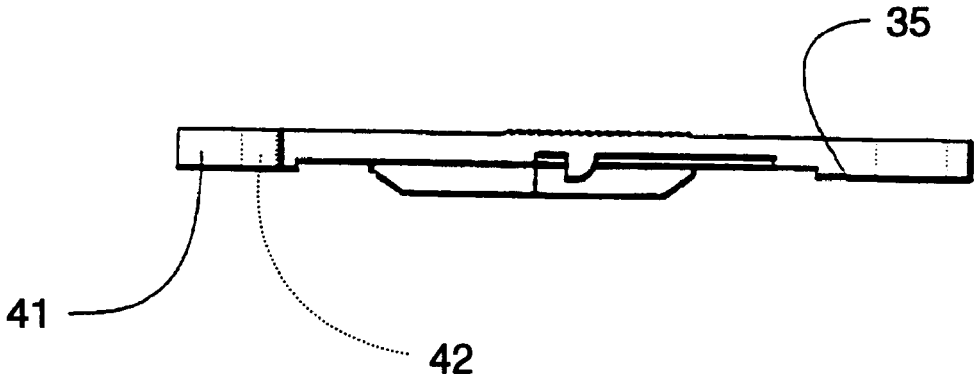
Fig. 9

LOCK-STITCH NEEDLE CHUCK FOR A PLACKET SEWING MACHINE

TECHNICAL FIELD AND BACKGROUND OF INVENTION

This invention relates generally to a sewing machine for forming a knit shirt placket, and more specifically to a lock-stitch needle chuck and placket assembly formed using the needle chuck. The invention has particular application in the assembly of Allen Solley shirt plackets, such as that common in golf shirts and other casual knit shirts. The sewing machine of the present invention substantially eliminates the pucker typically formed at a bottom corner of the knit shirt placket, thus improving the aesthetic appearance of the shirt.

The process of forming a shirt placket requires precise sewing and cutting of the overlaid placket patch and shirt front. The placket patch is typically sewn to the shirt front using a conventional lock-stitch, double needle sewing machine with a center cutter located between and slightly to the rear of the needles. The double needles sew parallel lines of stitches in the placket patch and shirt front while the cutter cuts the fabric parts at a point between the stitch lines. Ideally, the stitch lines terminate at exact predetermined points such that the patch is properly sewn to the shirt front, and properly cut.

According to one prior art technique, the machine operator would manually feed and guide the overlaid placket patch and shirt front through the sewing machine, and attempt to stop the sewing motor at the exact moment the trailing end of the placket patch was reached. This manual technique was generally slow, and often produced rejects due primarily to human error. In an effort to overcome this problem, some prior art machines employed an electronic motor with stitch counting capability. The machine automatically stopped sewing after a predetermined stitch count. Although this machine was far more effective than the manual technique, it nevertheless suffered from many drawbacks and limitations. For example, stitch counting was unable to compensate for different size patches, placement variations, different stitch lengths, cloth puckering, and poor handling of the cloth by the machine operator.

As described in the Applicant's prior issued patents, U.S. Pat. Nos. 5,862,767 and 5,868,090, these and other problems of the prior art were substantially resolved by utilizing a light transmitter and fiber optic cable to sense the end of the placket patch, and automatically stop operation of the sewing motor. This technique produced a consistently accurate stitch and cut. The signal receiving end of the fiber optic cable was secured in an opening formed in the throat plate of the sewing machine in an area outside of the sewing and cutting elements of the machine. The fiber optic cable does not interfere with operation of the sewing needles or cutter, yet is positioned sufficiently close to these elements to accurately determine the trailing edge of the placket patch and relay this information to a programmable motor controller to stop the machine at the desired point.

While the sewing machine described in the Applicant's prior patents greatly improved the assembly of the placket patch and shirt front, there remained a need in the industry to improve the overall finished look of the shirt placket. A largely aesthetic problem common in most knit shirts is the slight puckering that occurs at the bottom corner of the shirt placket during wear. This puckering results from the inversion and folding of the placket patch after sewing and cutting. Through its research and experimentation, Applicant determined that by adding one or two extra stitches on one of the two parallel stitch lines made during formation of the placket assembly, the puckering formed at the bottom end of the finished placket was substantially eliminated.

SUMMARY OF THE INVENTION

Therefore, it is an object of the invention to provide a placket sewing machine which forms a substantially pucker-free shirt front.

It is another object of the invention to provide a lock-stitch needle chuck for use in a placket sewing machine, and adapted for sewing extra stitches along one of two parallel lines of stitches during formation of the placket assembly to substantially eliminate the pucker typically formed at the bottom end of the shirt placket in casual knit shirts.

It is another object of the invention to provide a method of forming a shirt placket assembly which substantially eliminates the pucker typically formed at the bottom end of the shirt placket in casual knit shirts.

These and other objects of the present invention are achieved in the preferred embodiments disclosed below by providing a placket sewing machine for attaching a placket patch to a fabric part of a garment in overlying relation to form a multiple layer placket assembly. The placket sewing machine includes a base defining a working surface of the sewing machine, and including a fabric moving feed dog for moving the overlaid placket patch and fabric part downstream through the sewing machine. A reciprocating needle chuck has first and second needle openings formed in a staggered forward and rearward arrangement. First and second sewing needles are positioned within respective needle openings of the chuck. The sewing needles are adapted for carrying respective ends of thread into and through the overlaid placket patch and fabric part to form first and second parallel lines of stitches in the placket assembly. The first line of stitches extends a greater distance along the length of the overlaid placket patch and fabric part than the second line of stitches. A sewing motor is operatively connected to the needle chuck for actuating the chuck during operation of the sewing machine. A fabric cutter is located downstream of and centrally disposed between the first and second sewing needles for cutting the overlaid placket patch and fabric part after sewing.

According to another preferred embodiment of the invention, a motor controller is provided for controlling operation of the sewing motor and needle chuck.

According to another preferred embodiment of the invention, ply-sensing means are operatively connected to the motor controller for automatically stopping operation of the sewing motor and needle chuck upon sensing a trailing end of the placket patch.

According to another preferred embodiment of the invention, the ply-sensing means includes a transmitter mounted above the base of the sewing machine for transmitting a ply-sensing signal of sufficient intensity such that the signal is capable of penetrating the thickness of the fabric part, and is interrupted by the multi-layer thickness of the overlaid placket patch and fabric part.

According to another preferred embodiment of the invention, the ply-sensing means further includes a receiver located in the base of the sewing machine and in signal-passage alignment with the transmitter for receiving the signal of the transmitter through the fabric part. The transmitter and receiver are located respectively on opposite sides of the overlaid placket patch and fabric part. Upon interruption of the ply-sensing signal indicating a presence of both the placket patch and fabric part, the motor controller maintains operation of the sewing motor and needle chuck. Upon receiving the ply-sensing signal of the transmitter indicating an absence of the placket patch, the motor controller stops operation of the sewing motor and needle chuck.

According to another preferred embodiment of the invention, a throat plate is provided for supporting the overlaid placket patch and fabric part on the working surface of the base in an area of the first and second sewing needles. The throat plate defines an opening for accommodating passage of the reciprocating needles and movement of the feed dog.

According to another preferred embodiment of the invention, the throat plate includes a side extension located outside of an area of the sewing needles. The extension of the throat plate defines a port for holding the receiver in signal passage alignment with the transmitter during placket sewing operations.

In another preferred embodiment, the invention is a needle chuck adapted for use in a placket sewing machine for attaching a placket patch to a fabric part of a garment in overlying relation to form a multiple layer placket assembly. The needle chuck includes first and second needle openings formed in a staggered forward and rearward arrangement and adapted for holding first and second sewing needles. The sewing needles are adapted for carrying respective ends of thread into and through the overlaid placket patch and fabric part to form first and second parallel lines of stitches in the placket assembly. The first line of stitches extends a greater distance along the length of the overlaid placket patch and fabric part than the second line of stitches. Locking means holds the first and second sewing needles in a rigid fixed condition.

According to another preferred embodiment of the invention, the locking means includes respective set screws adapted for entering the needle chuck and engaging the sewing needles.

According to another preferred embodiment of the invention, cutter holding means holds a fabric cutter in a fixed rigid condition between the first and second needle openings.

In another preferred embodiment, the invention is a multiple layer placket assembly for being incorporated into a garment. The placket assembly includes a fabric part of a garment and a placket patch overlying the fabric part of the garment. First and second parallel lines of stitches are formed into and through the placket patch and fabric part to attach the placket patch and fabric part together. The first line of stitches extends a greater distance along the length of the overlaid placket patch and fabric part than the second line of stitches.

According to another preferred embodiment of the invention, a longitudinal cut is formed through the placket patch and fabric part in an area between the first and second line of stitches.

In another preferred embodiment, the invention is a method of forming a placket assembly including a placket patch and a fabric part of a garment. The method includes the steps of positioning the placket patch and fabric part in overlying relation on a working surface of a placket sewing machine. First and second ends of thread are then carried into and through the overlaid placket patch and fabric part to form first and second parallel lines of stitches in the placket assembly. The first line of stitches extends a greater distance along the length of the overlaid placket patch and fabric part than the second line of stitches. The overlaid placket patch and fabric part is then cut longitudinally in an area between the first and second lines of stitches.

BRIEF DESCRIPTION OF THE DRAWINGS

Some of the objects of the invention have been set forth above. Other objects and advantages of the invention will appear as the description proceeds when taken in conjunction with the following drawings, in which:

FIG. 8 is a top plan view of a throat plate according to one preferred embodiment of the invention for use in the placket sewing machine;

FIG. 9 is a side elevational view of the throat plate;

DESCRIPTION OF THE PREFERRED EMBODIMENT AND BEST MODE

Figure 1:
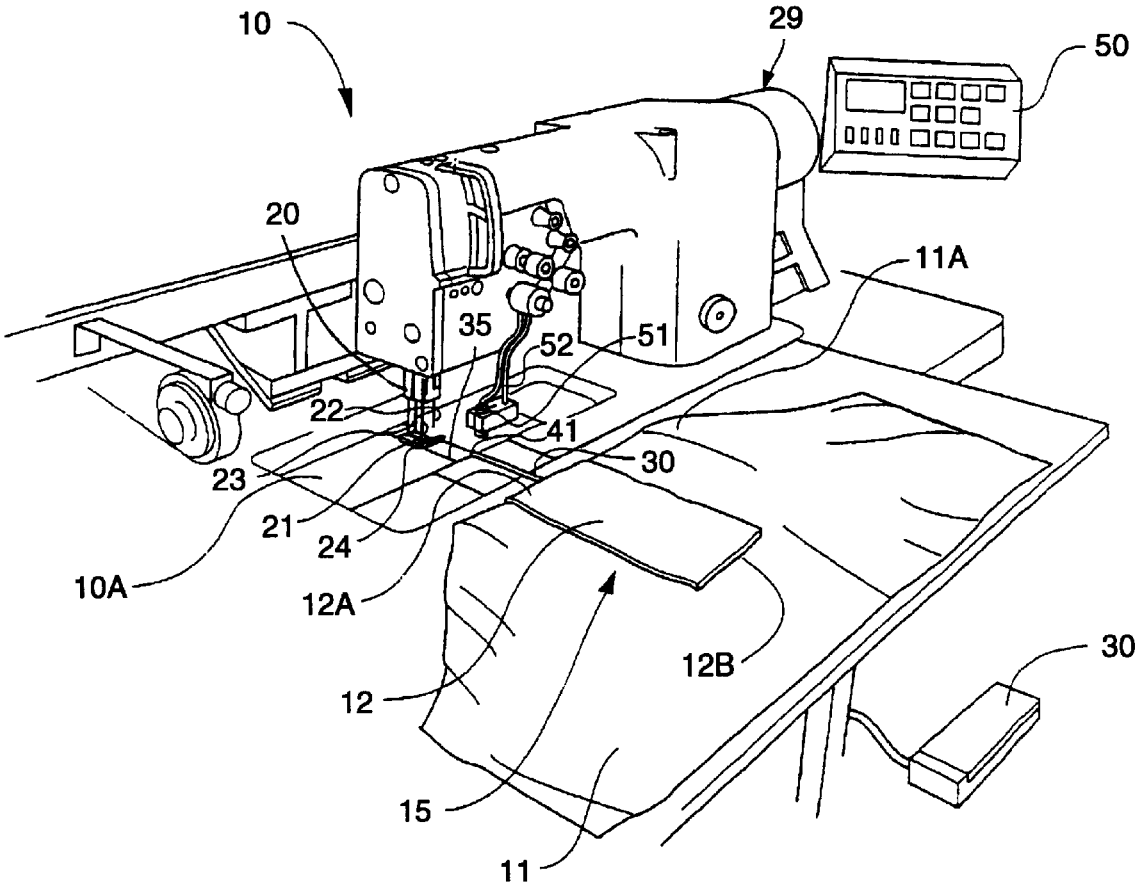
FIG. 1 is a perspective view of a placket sewing machine according to one preferred embodiment of the invention, and showing a shirt front and overlaid placket patch just prior to being fed through the sewing and cutting elements of the machine.
Figure 2:
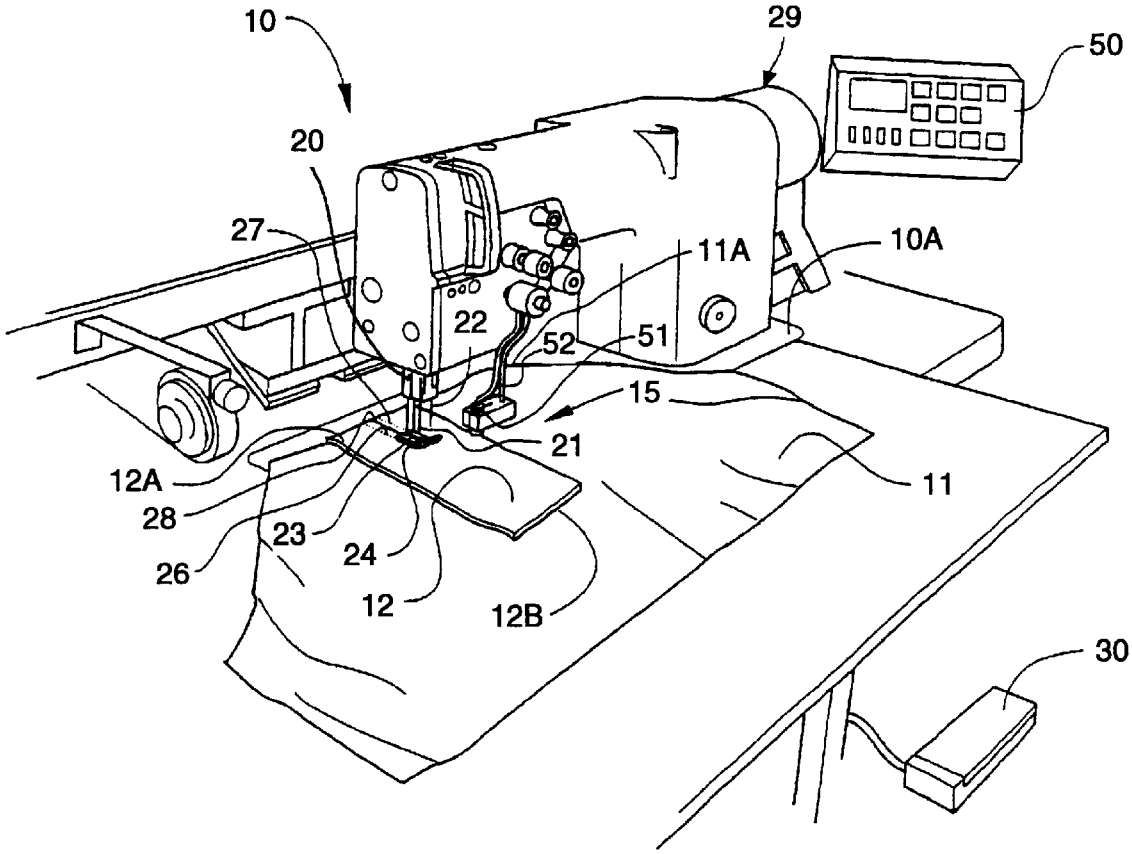
FIG. 2 is a perspective view of the placket sewing machine, and showing the shirt front and overlaid placket patch moving downstream through the sewing and cutting elements of the machine.

Referring now specifically to the drawings, a placket sewing machine according to the present invention is illustrated in FIGS. 1 and 2, and shown generally at reference numeral 10. The sewing machine 10 is particularly adapted to form an Allen Solley shirt placket "P", such as that illustrated generally in FIG. 3. The sewing machine 10 substantially eliminates the pucker typically formed at a bottom corner "C" of the shirt placket "P", thus improving the overall aesthetic appearance of the shirt "S".

Figure 3:
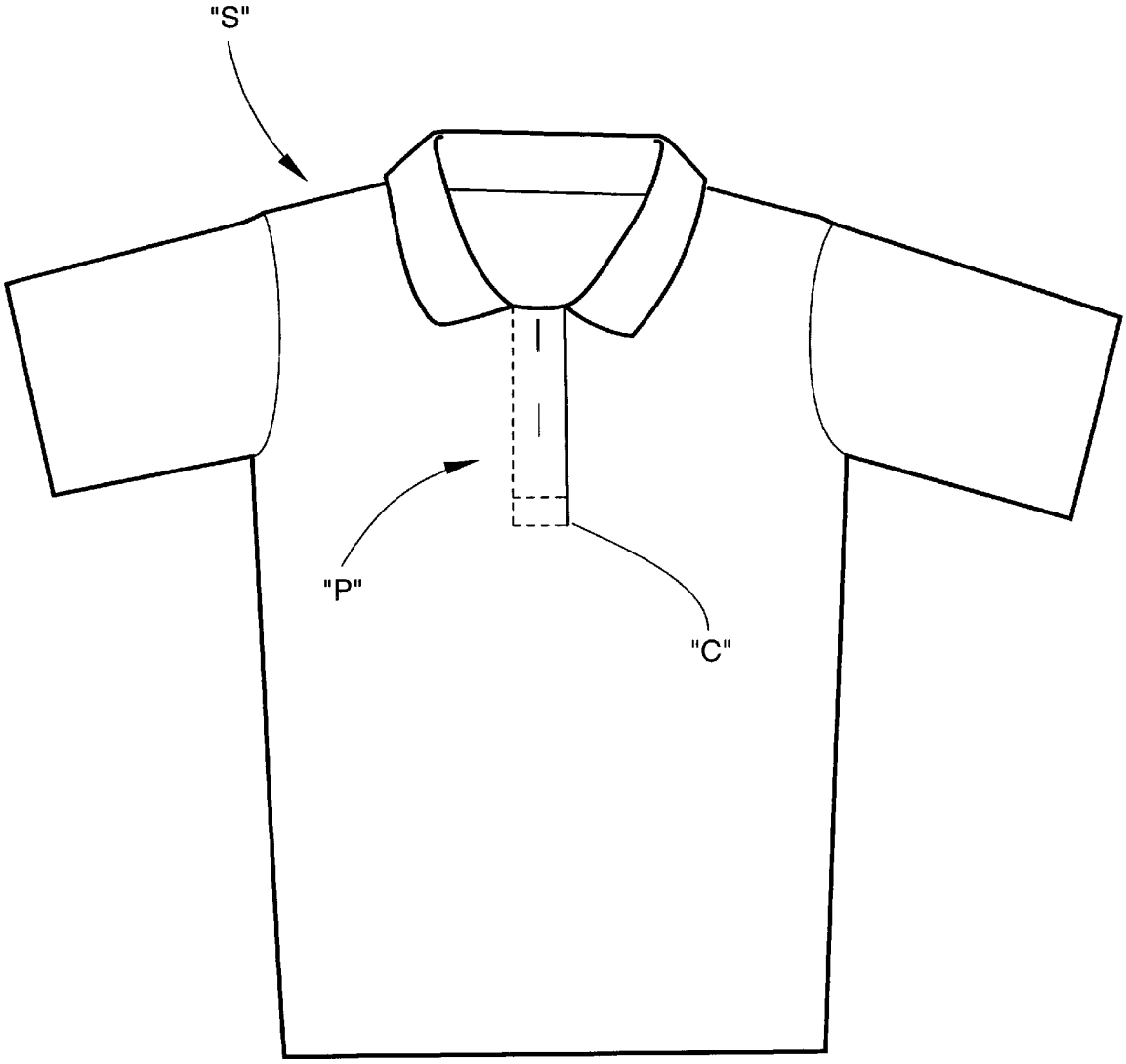
FIG. 3 is a front view of a knit shirt including an Allen Solley shirt placket.

Referring to FIGS. 1 and 2, a shirt front 11 and overlaid placket patch 12 are positioned on a working surface of the sewing machine 10 with respective front edges 11A and 12A aligned in registration to define a leading end of a shirt placket assembly 15. An opposite rear edge 12B of the placket patch 12 defines a trailing end of the placket assembly 15. As described further below, the placket assembly 15 is fed into the sewing machine 10 and moved downstream for sewing and cutting. Upon reaching the trailing end of the placket patch 12, the machine 10 automatically stops operation at an exact predetermined point, thus forming a precise cut and stitch in the placket assembly 15. The placket assembly 15 is subsequently formed into a shirt placket "P" as shown in FIG. 3.

Figure 4:
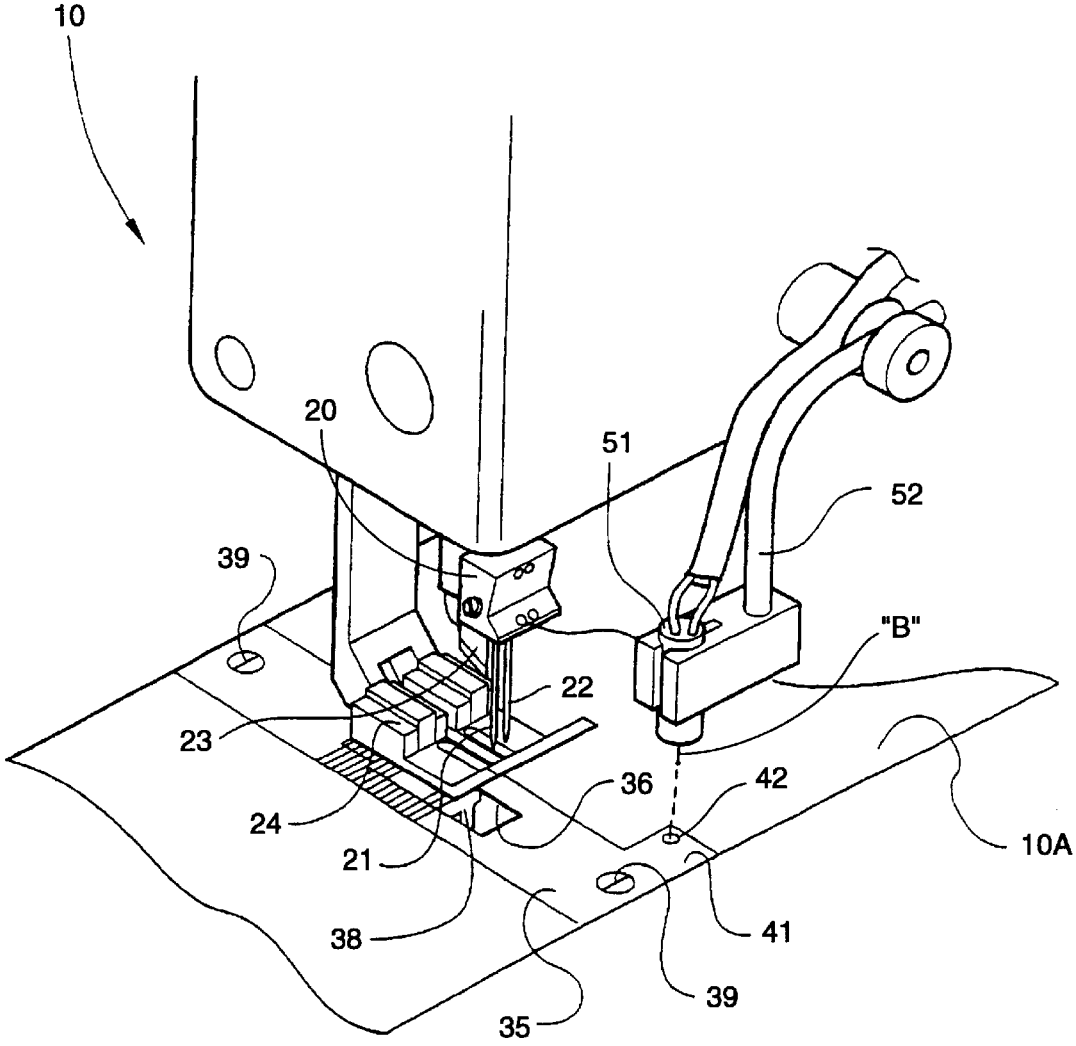
FIG. 4 is an enlarged, fragmentary perspective view of the cutting and sewing elements of the placket sewing machine.

The sewing and cutting elements of the machine 10 are best illustrated in FIGS. 1, 2, and 4. A conventional sewing head carries a reciprocating needle chuck 20 including a pair of sewing needles 21, 22 and a cutter 23, and a presser foot 24. These elements operate in conjunction to simultaneously form two spaced apart parallel lines of stitching 26 and 27 in the placket assembly 15. The cutter 23 cuts the placket assembly 15 at a center point 28 between the two stitch lines 26 and 27, as indicated in FIG. 2. A standard electronic sewing motor 29 operates a drive assembly to actuate the needle chuck 20. The motor 29 is operatively connected to a footpad control 30 for being depressed by a machine operator. Preferably, a guide bar 30 is provided on the working surface of the sewing machine 10 to maintain a straight sew and cut as the placket assembly 15 is moved by the operator downstream through the sewing machine 10.

Figure 5:
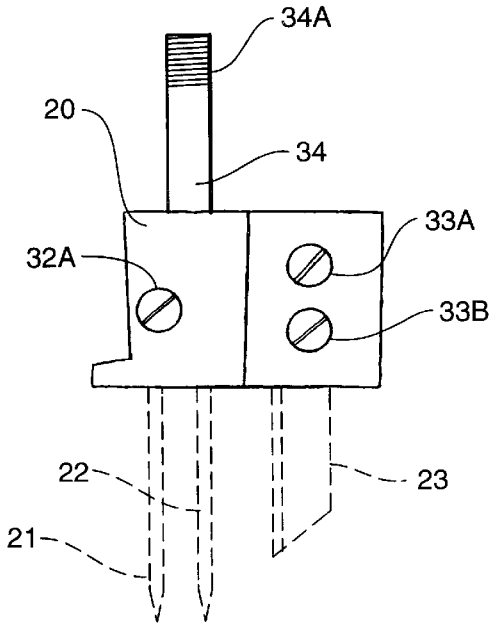
FIG. 5 is a left side elevational view of the needle chuck according to one preferred embodiment of the invention, and showing the sewing needles and cutter in phantom.
Figure 6:
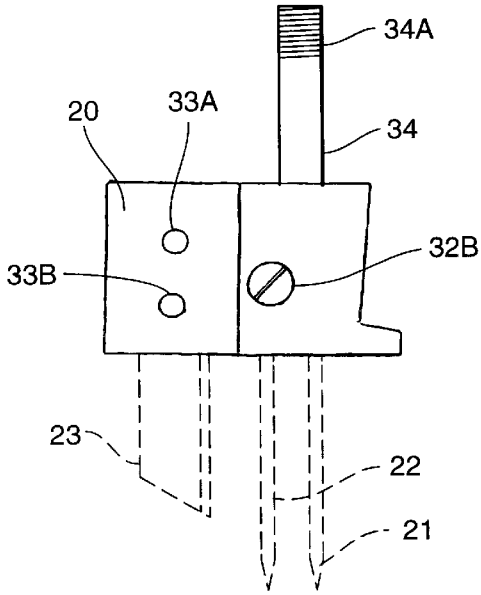
FIG. 6 is a right side elevational view of the needle chuck with the sewing needles and cutter shown in phantom.
Figure 7:
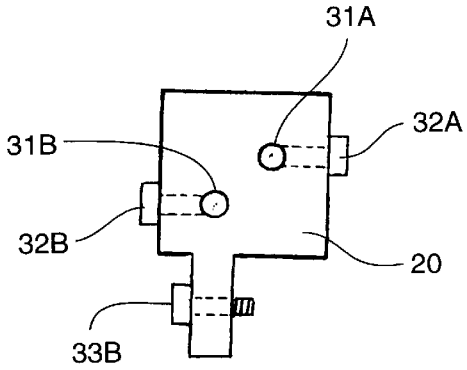
FIG. 7 is a bottom plan view of the needle chuck.

As shown in FIGS. 5–7, the needle chuck 20 has a main body portion defining a pair of spaced-apart internal needle openings 31A and 31B formed in a staggered forward and rearward arrangement relative to the direction of movement of the placket assembly 15. The sewing needles 21 and 22 are removably secured in a rigid, fixed condition in the needle openings 31A, 31B of the chuck 20 by respective threaded set screws 32A and 32B. The set screws 32A and 32B enter complementary-threaded openings formed in the chuck 20 to engage the needles 21 and 22. The fabric cutter 23 is attached to the rear of the needles 21 and 22 by threaded attachment screws 33A, 33B extending through respective aligned openings in the cutter 23 and a rear mounting plate formed with the main body portion of the chuck 20. A connecting shaft 34 extends upwardly from the main body portion of the chuck 20, and has a threaded end 34A adapted for being received into a complementary-threaded opening in the sewing head of the sewing machine 10. The needle chuck 20 is operatively connected to the sewing motor 29 in a conventional manner using other conventional elements not shown.

Referring to FIGS. 4, 8, and 9, a throat plate 35 is located immediately below the needle chuck 20 on a base 10A of the sewing machine 10, and includes a center opening 36 vertically aligned with the presser foot 24 for accommodating passage of the reciprocating needles 21 and 22 and cutter 23 downwardly into the base 10A. A feed dog 38 is periodically exposed upwardly through the center opening 36 for engaging and urging the placket assembly 15 downstream through the sewing machine 10. Preferably, the throat plate 35 is removably secured to the base 10A of the machine 10 by threaded screws 39.

An extension 41 is integrally formed with one side of the throat plate 35, and includes an internally threaded port 42 for receiving and holding a complementary threaded end of fiber optic cable 44 in an area of the base 10A outside of the sewing and cutting elements of the machine 10. The fiber optic cable 44 extends from the throat plate 35 through the base 10A, and communicates with a programmable motor controller 50 shown in FIGS. 1 and 2. The motor controller 50 includes an override command for automatically stopping operation of the sewing motor 29.

Figure 10:
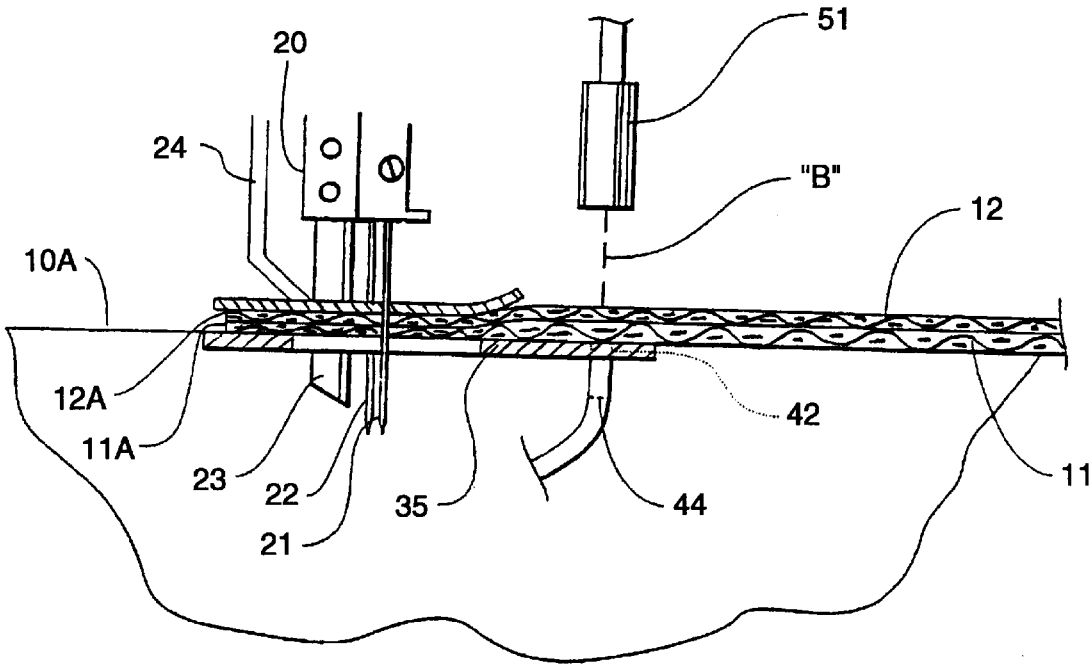
FIG. 10 is a partial cross-section of the placket sewing machine with a leading end of the placket patch and shirt front fed into the sewing and cutting elements of the machine, and showing blocked transmission of the light beam from the transmitter to the receiver.
Figure 11:
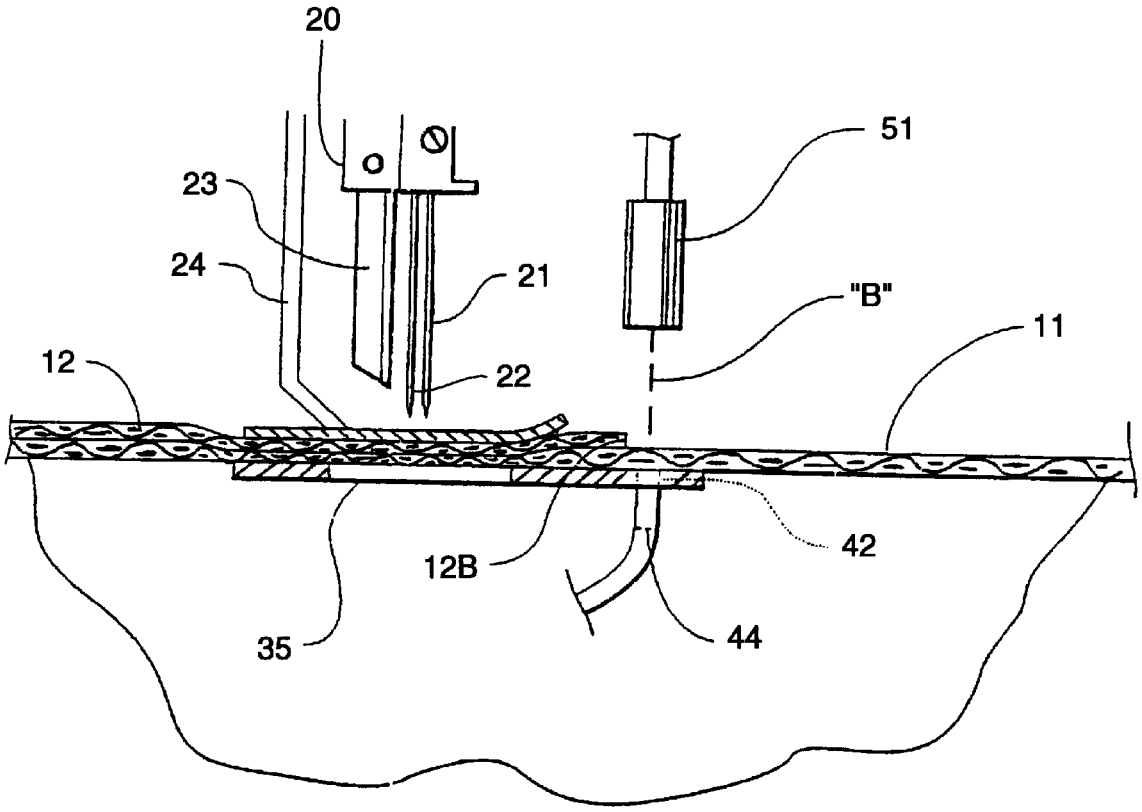
FIG. 11 is a partial cross-section of the placket sewing machine with a trailing end of the placket patch located downstream of the transmitter and receiver, and showing transmission of the light beam from the transmitter through the shirt front and into the receiver.

As best shown in FIGS. 4, 10, and 11, a transmitter 51 is secured to a support arm 52 in precise signal-passage alignment with the fiber optic cable 44 for transmitting a high intensity light beam "B" in a direction of the fiber optic cable 44. Passage of the light beam "B" into the cable 44 triggers the override command of the motor controller 50, and automatically stops operation of the sewing motor 29. The sewing motor 29 will not operate in this condition regardless of pressure applied by the operator to the footpad 30. To operate the sewing motor 29, transmission of the light beam "B" into the fiber optic cable 44 must be blocked, and the footpad 30 simultaneously depressed by the operator.

Referring to FIGS. 10 and 11, the light transmitter 51 and fiber optic cable 44 cooperate to sense the trailing end of the placket assembly 15, and thereby direct the motor controller 50 to automatically stop sewing and cutting operations of the sewing motor 29. As shown in FIG. 10, the double thickness of the shirt front 11 and overlaid placket patch 12 is sufficient to interrupt passage of the light beam "B" into the fiber optic cable 44. With the footpad 30 depressed, the machine operator manually feeds the leading end of the placket assembly 15 into the sewing machine 10 covering the port 42 of the throat plate 35. The relative thickness of the fabric parts 11 and 12 blocks transmission of the light beam "B" into the receiving end of the fiber optic cable 44 to permit operation of the sewing motor 29. The reciprocating needles 21 and 22 and cutter 23 held by the needle chuck 20 stitch and cut the packet assembly 15 as described above, while the feed dog 38 moves the placket assembly 15 downstream through the machine 10. Upon reaching the trailing end of the placket assembly 15, as shown in FIG. 11, the light beam "B" of the transmitter 51 penetrates the fabric of the shirt front 11, and passes into the receiving end of fiber optic cable 44 located in the port 52 of the throat plate 35. Operation of the sewing motor 29 stops, and the placket assembly 15 is subsequently moved downstream for further processing. Preferably, the intensity of the light beam "B" is adjustable to accommodate the particular fabric of the shirt front 11. For example, a heavier cloth may require increased beam intensity. In addition, the motor controller 50 may be programmed to account for tight knit or loose knit fabrics, and to automatically stop the sewing motor 29 after a predetermined stitch count, thus accounting for the distance between the transmitter 51 and sewing needles 21 and 22. An example of a suitable motor controller is that manufactured by EFKA of Germany, and sold as part number DC 1600 JU82 V740.

After sewing and cutting as described above, the placket assembly 15 preferably enters an automatic positioning apparatus to complete formation of the placket assembly. One suitable positioning machine is that described in U.S. Pat. No. 4,227,470. The complete disclosure of this patent is expressly incorporated herein by reference.

Figure 12:
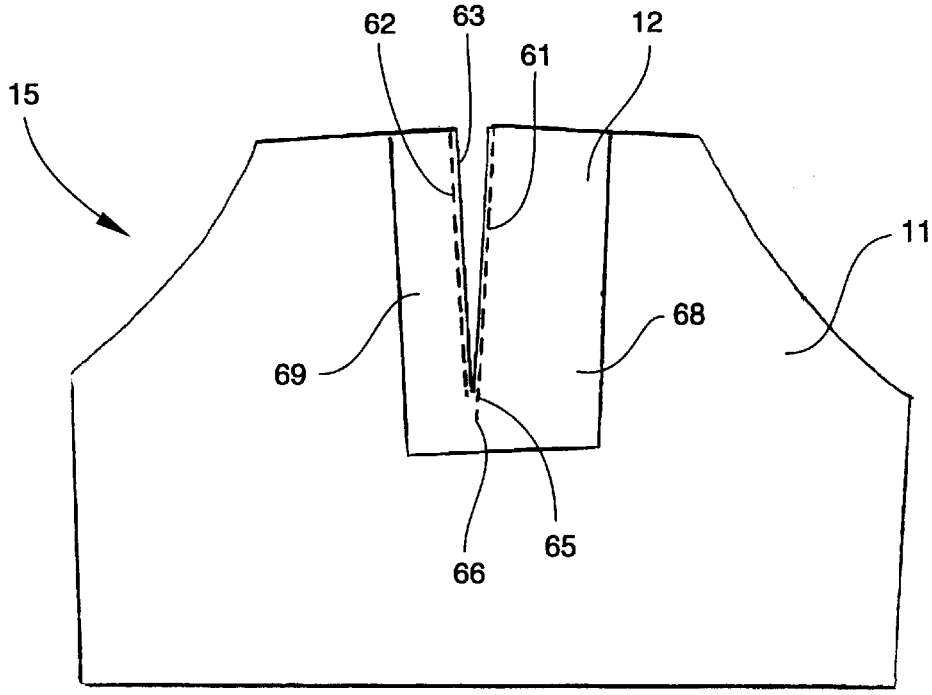
FIG. 12 is a view of the shirt front and overlaid placket patch after cutting and sewing.
Figure 13:
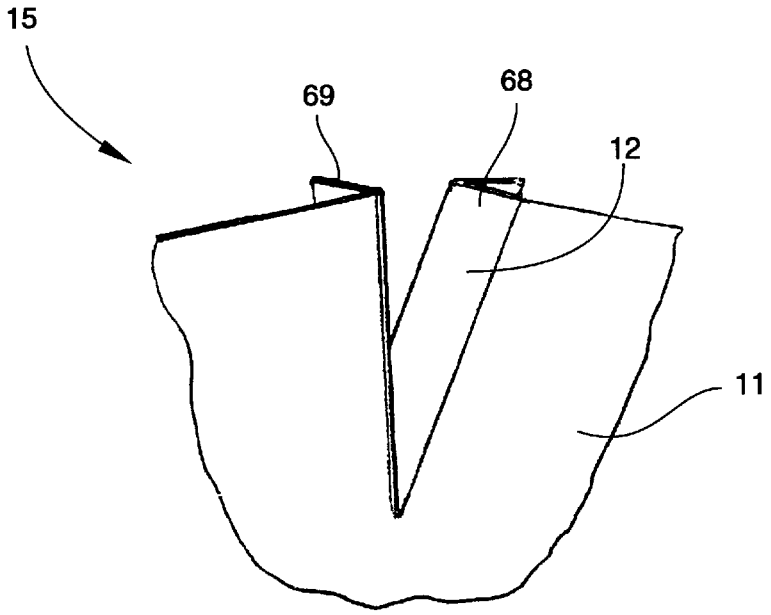
FIG. 13 is a fragmentary perspective view of the folded placket assembly.

A finished placket assembly 15 formed according to the present invention is shown in FIGS. 12 and 13. The cutting and sewing elements of the placket sewing machine 10, described above, cooperate with respective ends of thread to form first and second parallel lines of stitches 61 and 62 in the overlaid placket patch 12 and shirt front 11, and a longitudinal cut 63 through the placket assembly 15 in an area between the lines of stitches 61 and 62. As a result of the staggered forward and rearward arrangement of the sewing needles 21 and 22, the first line of stitches 61 extends a greater distance along the length of the placket assembly than the second line of stitches 62. Preferably, the first line of stitches 61 extends exactly two stitches 65 and 66 beyond the end of the second line of stitches 62. The cut 63 terminates at the end of the second line of stitches 62 and defines a relatively wide placket section 68 and a relatively narrow placket section 69. To form the placket assembly 15, the sections 68 and 69 of the placket patch 12 are folded outwardly away from the shirt front 11 and then through the longitudinal cut 63. The wider section 68 of the placket patch 12 is then folded over onto itself, as shown in FIG. 13. Because of the added stitches 65 and 66 formed in the line of stitches 61, the bottom end of the folded placket assembly 15 is essentially free of any puckering.

A placket sewing machine including a lock-stitch needle chuck is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A placket sewing machine for attaching a placket patch to a fabric part of a garment in overlying relation to form a multiple layer placket assembly, the placket sewing machine comprising:

(a) a base defining a working surface of the sewing machine, and including a fabric moving feed dog for moving the overlaid placket patch and fabric part downstream through the sewing machine;

(b) a reciprocating needle chuck having first and second needle openings formed in a staggered forward and rearward arrangement;

(c) first and second sewing needles positioned within respective needle openings of said chuck, and adapted for carrying respective ends of thread into and through the overlaid placket patch and fabric part to form first and second parallel lines of stitches in the placket assembly, said first line of stitches extending a greater distance along the length of the overlaid placket patch and fabric part than said second line of stitches;

(d) a sewing motor operatively connected to said needle chuck for actuating said needle chuck during operation of the sewing machine; and (e) a fabric cutter located downstream of and centrally disposed between said first and second sewing needles for cutting the overlaid placket patch and fabric part after sewing.

2. A placket sewing machine according to claim 1, and comprising a motor controller for controlling operation of the sewing motor and needle chuck.

3. A placket sewing machine according to claim 2, and comprising ply-sensing means operatively connected to the motor controller for automatically stopping operation of the sewing motor and needle chuck upon sensing a trailing end of the placket patch.

4. A placket sewing machine according to claim 3, wherein said ply-sensing means comprises a transmitter mounted above said base of the sewing machine for transmitting a ply-sensing signal of sufficient intensity such that the signal is capable of penetrating the thickness of the fabric part, and is interrupted by the multi-layer thickness of the overlaid placket patch and fabric part.

5. A placket sewing machine according to claim 4, wherein said ply-sensing means further comprises a receiver located in said base of the sewing machine and in signal-passage alignment with said transmitter for receiving the signal of the transmitter through the fabric part, said transmitter and receiver being located respectively on opposite sides of the overlaid placket patch and fabric part, whereby upon interruption of the ply-sensing signal indicating a presence of both the placket patch and fabric part, the motor controller maintains operation of the sewing motor and needle chuck, and upon receiving the ply-sensing signal of the transmitter indicating an absence of the placket patch, the motor controller stops operation of the sewing motor and needle chuck.

6. A placket sewing machine according to claim 5, and comprising a throat plate for supporting the overlaid placket patch and fabric part on the working surface of said base in an area of said first and second sewing needles, said throat plate defining an opening therein for accommodating passage of the reciprocating needles and movement of the feed dog.

7. A placket sewing machine according to claim 6, wherein said throat plate comprises a side extension located outside of an area of the sewing needles, said extension of the throat plate defining a port therein for holding the receiver in signal passage alignment with the transmitter during placket sewing operations.

8. A multiple layer placket assembly for being incorporated into a garment, said placket assembly comprising:

(a) a fabric part of a garment;

(b) a placket patch overlying the fabric part of the garment; and (c) first and second parallel lines of stitches formed into and through said placket patch and fabric part to attach said placket patch and fabric part together, said first line of stitches extending a greater distance along the length of said overlaid placket patch and fabric part than said second line of stitches.

9. A multiple layer placket assembly according to claim 8, and comprising a longitudinal cut through said placket patch and fabric part in an area between said first and second line of stitches.

10. A method of forming a placket assembly comprising a placket patch and a fabric part of a garment, the method comprising the steps of:

(a) positioning the placket patch and fabric part in overlying relation on a working surface of a placket sewing machine, (b) carrying first and second ends of thread into and through the overlaid placket patch and fabric part to form first and second parallel lines of stitches in the placket assembly, the first line of stitches extending a greater distance along the length of the overlaid placket patch and fabric part than the second line of stitches; and (c) cutting the overlaid placket patch and fabric part longitudinally in an area between the first and second lines of stitches.

* * * * *